US012091930B2

(12) United States Patent
Moreno et al.

(10) Patent No.: US 12,091,930 B2
(45) Date of Patent: Sep. 17, 2024

(54) LINER HANGER SLIP RETENTION SYSTEM AND METHOD

(71) Applicant: Schlumberger Technology Corporation, Sugar Land, TX (US)

(72) Inventors: Carlos Moreno, Rosharon, TX (US); Michael Underbrink, Eureka, MO (US); Kameron Lee Klauber, Rosharon, TX (US); Martin Hernandez, Pearland, TX (US); James Rounding, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 50 days.

(21) Appl. No.: 17/759,450

(22) PCT Filed: Jan. 28, 2021

(86) PCT No.: PCT/US2021/015367
§ 371 (c)(1),
(2) Date: Jul. 26, 2022

(87) PCT Pub. No.: WO2021/154907
PCT Pub. Date: Aug. 5, 2021

(65) Prior Publication Data

US 2023/0072517 A1 Mar. 9, 2023

Related U.S. Application Data

(60) Provisional application No. 62/966,677, filed on Jan. 28, 2020.

(51) Int. Cl.

| | |
|---|---|
| ***E21B 33/129*** | (2006.01) |
| ***E21B 23/01*** | (2006.01) |
| ***E21B 43/10*** | (2006.01) |

(52) U.S. Cl.
CPC ..... *E21B 33/129* (2013.01); *E21B 23/01* (2013.01); *E21B 43/10* (2013.01)

(58) Field of Classification Search
CPC ..... E21B 33/129; E21B 23/01; E21B 23/03; E21B 23/04
See application file for complete search history.

(56) References Cited

U.S. PATENT DOCUMENTS 4,059,150 A 11/1977 Manderscheid
4,060,131 A 11/1977 Kenneday et al.
(Continued)

FOREIGN PATENT DOCUMENTS

CN 203161142 U 8/2013
JP 2004106049 A * 4/2004
(Continued)

OTHER PUBLICATIONS

International Search Report and Written Opinion issued in PCT Application PCT/US2021/015367, dated May 7, 2021 (11 pages).
(Continued)

*Primary Examiner* — D. Andrews
*Assistant Examiner* — Ronald R Runyan
(74) *Attorney, Agent, or Firm* — Jeffrey D. Frantz

(57) ABSTRACT

A technique facilitates deploying and setting a liner hanger assembly while securely retaining liner hanger slips during running-in-hole. The liner hanger assembly may comprise a variety of components such as a mandrel, a cone, a plurality of slips, a retention ring, and an actuator. The slips may each be configured with an upper retention end and a lower retention end having a plurality of angles which interlock with corresponding angles of the cone and the retention ring. Additionally, a portion of the actuator may be sized to slide
(Continued)

over an axial end of the retention ring to prevent inadvertent decoupling of the slips after installing the slips along the exterior of the cone.

19 Claims, 3 Drawing Sheets

(56) References Cited

U.S. PATENT DOCUMENTS

| | | | |
|---|---|---|---|
| 4,096,913 | A | 6/1978 | Kenneday et al. |
| 4,662,453 | A | 5/1987 | Brisco |
| 4,688,642 | A | 8/1987 | Baker |
| 4,711,326 | A | 12/1987 | Baugh et al. |
| 4,732,212 | A | 3/1988 | Fraser, III |
| 4,750,563 | A | 6/1988 | Baugh |
| 4,762,177 | A | 8/1988 | Smith, Jr. |
| 4,834,185 | A | 5/1989 | Braddick |
| 5,086,845 | A | 2/1992 | Baugh |
| 5,174,397 | A | 12/1992 | Currington |
| 5,311,941 | A | 5/1994 | Baugh |
| 5,318,131 | A | 6/1994 | Baker |
| 5,487,427 | A | 1/1996 | Curington |
| 6,877,567 | B2 | 4/2005 | Hirth |
| 7,431,096 | B2 | 10/2008 | Fay |
| 7,614,449 | B2 | 11/2009 | Anderson |
| 7,766,088 | B2 | 8/2010 | Saucier et al. |
| 8,047,279 | B2 | 11/2011 | Barlow et al. |
| RE43,198 | E | 2/2012 | Anderson |
| 8,584,765 | B2 | 11/2013 | Slup |
| 8,978,772 | B2 | 3/2015 | Yates et al. |
| 9,556,714 | B2 | 1/2017 | Hughes et al. |
| 9,752,418 | B2 | 9/2017 | Meador et al. |
| 9,759,027 | B2 | 9/2017 | Meador et al. |
| 9,803,435 | B2 | 10/2017 | Louviere et al. |
| 9,816,357 | B2 | 11/2017 | Abraham |
| 9,890,614 | B2 | 2/2018 | MacLeod et al. |
| 10,077,624 | B2 | 9/2018 | Doane |
| 10,145,202 | B2 | 12/2018 | Anderson et al. |
| 10,267,121 | B2 | 4/2019 | MacLeod et al. |
| 10,280,715 | B2 | 5/2019 | MacLeod et al. |
| 10,408,003 | B2 | 9/2019 | Moyes |
| 10,513,898 | B2 | 12/2019 | Allamon et al. |
| 10,633,942 | B2 | 4/2020 | Dockweiler |
| 2012/0012306 | A1 | 1/2012 | Treadaway et al. |
| 2012/0037381 | A1 | 2/2012 | Giroux et al. |
| 2014/0020911 | A1 | 1/2014 | Martinez |
| 2018/0023368 | A1 | 1/2018 | Anderson et al. |
| 2018/0112480 | A1 | 4/2018 | Allamon et al. |

FOREIGN PATENT DOCUMENTS

| | | | |
|---|---|---|---|
| JP | 20040106049 | A | 4/2004 |
| WO | 2006023952 | A1 | 3/2006 |
| WO | 2017119868 | A1 | 7/2017 |
| WO | 2018162897 | A1 | 9/2018 |
| WO | 2022098533 | A1 | 5/2022 |

OTHER PUBLICATIONS

International Search Report and Written Opinion issued in PCT Application PCT/US2021/056492, dated Feb. 14, 2022 (12 pages).
International Preliminary Report on Patentability issued in PCT Application PCT/US2021/056492 dated May 19, 2023, 9 pages.
International Preliminary Report on Patentability issued in PCT Application PCT/US2021/015367 dated Aug. 11, 2022, 8 pages.

* cited by examiner

RIH Position (Unset)

Set Position

LINER HANGER SLIP RETENTION SYSTEM AND METHOD

CROSS-REFERENCE TO RELATED APPLICATION

This application is a national stage entry under 35 U.S.C. 371 of International Application Serial No. PCT/US2021/015367, filed Jan. 28, 2021, which claims priority to U.S. Provisional Patent Application Ser. No. 62/966,677, filed Jan. 28, 2020, which is incorporated herein by reference in its entirety.

BACKGROUND

In many well applications, a wellbore is drilled and a casing string is deployed along the wellbore. A liner hanger may then be used to suspend a liner downhole within the casing string. The liner hanger may be hydraulically operated via a hydraulic cylinder to set hanger slips. Once the liner hanger is run-in-hole and positioned properly, the hanger slips are set against the surrounding casing string. The set slips are responsible for ensuring sufficient gripping of the surrounding casing string to hold the weight of the liner and to hold against mechanical and hydraulic loads applied to the system. While the liner hanger is run-in-hole, however, the slips should remain in a radially contracted position to avoid premature setting and/or loss of the hanger slips.

SUMMARY

In general, a system and methodology are provided for deploying and setting a liner hanger assembly while securely retaining the slips during running-in-hole. The liner hanger assembly may comprise a variety of components such as a mandrel, a cone, a plurality of slips, a retention ring, and an actuator, e.g. a hydraulic actuator cylinder. The slips may each be configured with an upper retention end and a lower retention end having a plurality of angles which interlock with corresponding angles of the cone and the retention ring. Additionally, a portion of the actuator may be sized to slide over an axial end of the retention ring to prevent inadvertent decoupling of the slips after installing the slips along the exterior of the cone.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
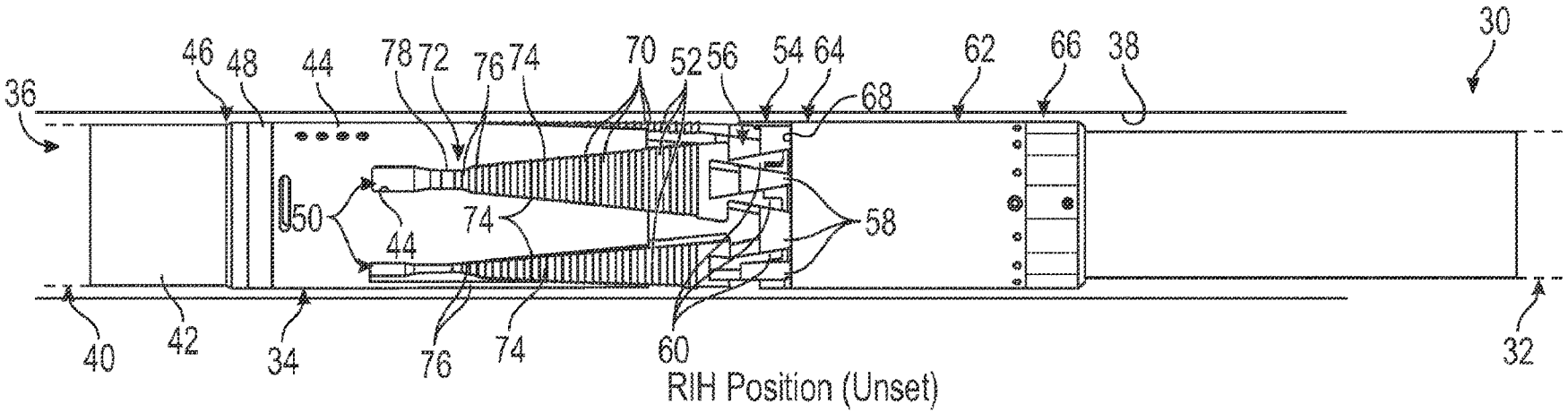
FIG. 1 is an illustration of an example of a liner hanger deployed in a borehole, e.g. a wellbore, during running-in-hole, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for deploying and setting a liner hanger assembly while securely retaining the slips during running-in-hole. A slip package combines slips and a cone in a manner which ensures the slips are fully retained: while running-in-hole; and in the event the liner hanger is inadvertently set in, for example, a larger casing such as a riser. The improved slip retention ensures the slips are not lost during operations and that the liner hanger can be retrieved in the event of a mis-run.

According to an embodiment, the liner hanger assembly may comprise a variety of components such as a mandrel, a cone, a plurality of slips, e.g. tapered slips, a retention ring, and an actuator, e.g. a hydraulic actuator cylinder. The slips may each be configured with an upper retention end and a lower retention end having a plurality of angles which interlock with corresponding angles of the cone and the retention ring. Additionally, a portion of the actuator/hydraulic cylinder may be sized to slide over an axial end of the retention ring to prevent inadvertent decoupling of the slips after installing the slips along the exterior of the cone.

By employing a unique combination of angles along the interacting components, the slips are securely retained when an upper end of each slip is engaged with the cone and a lower end of each slip is engaged with mating features of a retention ring. According to one embodiment, the combination of differing angles may be in the form of V-angles located at a top end of the slip. These V-angles interact with complementary (equal and opposite) V-angles defining a portion of the cone slot which receives the slip. Similarly, V-angles located at a bottom end of the slip are oriented to interact with complementary (equal and opposite) V-angles located along fingers of the retention ring.

Additionally, a properly sized diameter or other suitable feature of a cylinder may be slid over a portion of the retention ring to limit axial motion of the slips once installed along the exterior of the cone. Accordingly, the interacting V-angles of corresponding components (e.g. slips, cone, retention ring) prevent the slips from coming loose in a radial direction. Simultaneously, the cylinder prevents axial movement of the slips to a decoupling position after assembly of the liner hanger. This ensures secure retention of the slips during, for example, running-in-hole with the liner hanger. By way of example, the cylinder may be a hydraulic actuating cylinder although other types of actuating cylinders or cylindrical components may be used in cooperation with the retention ring.

According to an embodiment, the cylinder is a hydraulic actuating cylinder having an axial end face which can be selectively moved against the slips to shift the slips in an axial direction. When the slips are shifted in this axial direction, sloped surfaces of the cone force the slips radially outward and into engagement with the surrounding casing. As described in greater detail below, the slips and the cone may have cooperating sloped surfaces which effectively move the slips outwardly into engagement with the surrounding casing as the actuating cylinder pushes the slips in a linear/axial direction.

It should be further noted the configuration of the different angles (which effectively interlock cooperating components) also allows the slips to be assembled from the outside or exterior of the cone. For example, each slip may be inserted and twisted into position with respect to the cone and the retention ring so that interacting, angled surfaces prevent excess radial movement of the slip away from the cone. Once assembled, the cylinder may be installed over the retention ring to prevent linear movement of the slips to a decoupling or disassembly position.

Referring generally to FIG. 1, an embodiment of a liner hanger assembly 30 is illustrated as having a liner 32 coupled with a liner hanger 34. The liner hanger assembly 30 is deployed downhole into a borehole 36, e.g. a wellbore, which may be lined with a casing 38. In FIG. 1, the liner hanger 34 is illustrated in an unset, run-in-hole position which allows the liner hanger assembly 30 to be deployed via a liner hanger string 40 to a desired location along the borehole 36 and casing 38.

According to an example, the liner hanger 34 comprises an inner mandrel 42 having an internal passage through which, for example, fluid and/or equipment is able to move. In this embodiment, a cone 44 is slid onto the mandrel 42 to an abutment 46. In some applications, a spacer or bearing 48 may be positioned between the abutment 46 and the cone 44. The cone 44 may be generally tubular in structure and sized to slide along the tubular exterior of the mandrel 42.

Additionally, the cone 44 comprises a plurality of cone slots 50 arranged generally in an axial direction along a portion of the cone 44. The cone slots 50 are sized to receive corresponding hanger slips 52. As explained in greater detail below, the slips 52 may be assembled into the corresponding cone slots 50 from an outside or exterior of the cone 44. Depending on the engagement features of the cone 44/slips 52 and on parameters of the assembly process, the slips 52 may be assembled after cone 44 is slid onto mandrel 42 or before cone 44 is slid onto mandrel 42.

As illustrated, the liner hanger 34 also comprises a retainer or retention ring 54 which engages lower ends 56 of the slips 52 so as to facilitate retention of the slips 52 when, for example, the liner hanger assembly 30 is run-in-hole. By way of example, the retention ring 54 may comprise a plurality of retention ring fingers 58. The retention fingers 58 interlock with a plurality of corresponding slip fingers 60 located at the lower ends 56 of the slips 52.

On an opposite side of the retention ring 54 from slips 52, the retention ring 54 may be engaged by a cylinder 62 or other suitable actuator component. The cylinder 62 may have an engagement feature 64 which slides over and engages the retention ring 54. By way of example, the engagement feature 64 may be in the form of an expanded inner diameter section of the cylinder 62 which is sized to slide over a portion of the retention ring 54 before abutting the remaining portion of retention ring 54. Additionally, the cylinder 62 may be part of an overall actuator 66, e.g. a hydraulic actuator, a mechanical actuator, or another suitable actuator. For example, the cylinder may be a hydraulically actuated cylinder 62 or a mechanically actuated cylinder 62. The actuator 66 also may have other configurations and may use other types of engagement features 64.

Figure 2:
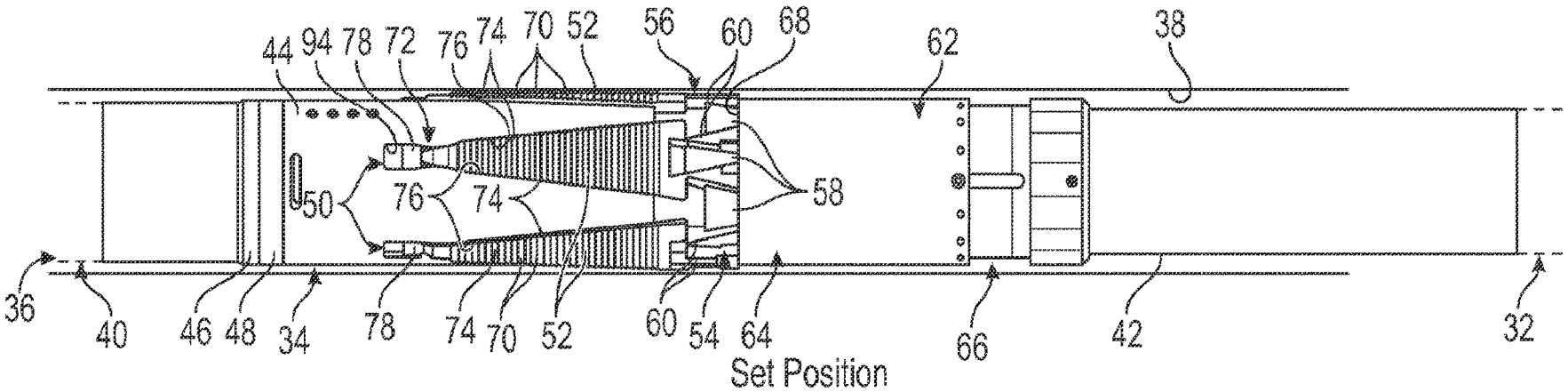
FIG. 2 is an illustration of the liner hanger shown in FIG. 1 but in a set position, according to an embodiment of the disclosure.

In the illustrated example, the cylinder 62 is a hydraulic cylinder which may be hydraulically actuated in an axial direction to shift the retention ring 54 until a face 68 of cylinder 62 is moved into abutting engagement with the lower ends 56 of the slips 52. Continued linear movement of the cylinder 62 in the direction toward slips 52 causes linear/axial movement of the slips 52. The linear movement of slips 52 effectively causes an interaction with cone 44 which forces the slips 52 radially outward into a set position, as illustrated in FIG. 2. In other words, the slips 52 and liner hanger 34 are transitioned from a radially contracted, run-in-hole position to a radially expanded set position.

In the set position, teeth 70 (or other types of gripping members) of the slips 52 are forced into gripping engagement with an interior surface of the surrounding casing 38. It should be noted the retention ring fingers 58 and the slip fingers 60 may be designed to allow a certain degree of relative linear movement with respect to each other. For example, during transition to the set position the cylinder 62 may initially shift the retention ring 54 linearly toward the lower ends 56 of slips 52, and then engage and linearly shift the slips 52.

In the example illustrated in FIGS. 1 and 2, each slip 52 is constructed as a tapered slip slidably received in the corresponding slots 50 which have corresponding tapers. For example, each slip 52 may taper along its length between an upper end 72 and lower end 56 such that upper end 72 is relatively narrow in a circumferential direction. From upper end 72, the slip 52 tapers outwardly in a circumferential direction on both circumferential sides of the slip such that the portion of the slip 52 proximate lower end 56 is wider than the relatively narrow upper end 72.

Each corresponding slot 50 also may be tapered with a corresponding taper that expands in a circumferential direction moving from an upper region of the slot 50 to a lower region of the slot 50. Additionally, the circumferential sides of each slip 52 may have angled surfaces 74 which taper inwardly moving in a radially inward direction. In other words, the radial exterior of each slip 52 is wider than the radial interior at each linear/axial position along the slip 52.

The slot 50 which receives the slip 52 has corresponding angled surfaces 76 which similarly cause the slot 50 to be circumferentially narrower at a radially inward position than a radially outward position. The corresponding tapers and angled surfaces 74, 76 are thus able to effectively cooperate and force the tapered slips 52 in a radially outward direction as the actuating cylinder 62 forces the slips 52 to move linearly with respect to cone 44 as cone 44 is held by abutment 46. It should be noted that each slip 52 also may comprise a head 78, e.g. a head having a hammerhead shape, at its upper end 72. As explained in greater detail below, the hammerheads 78 may be constructed to facilitate retention of slips 52 along cone 44 when liner hanger assembly 30 is run-in-in-hole.

Figure 3:
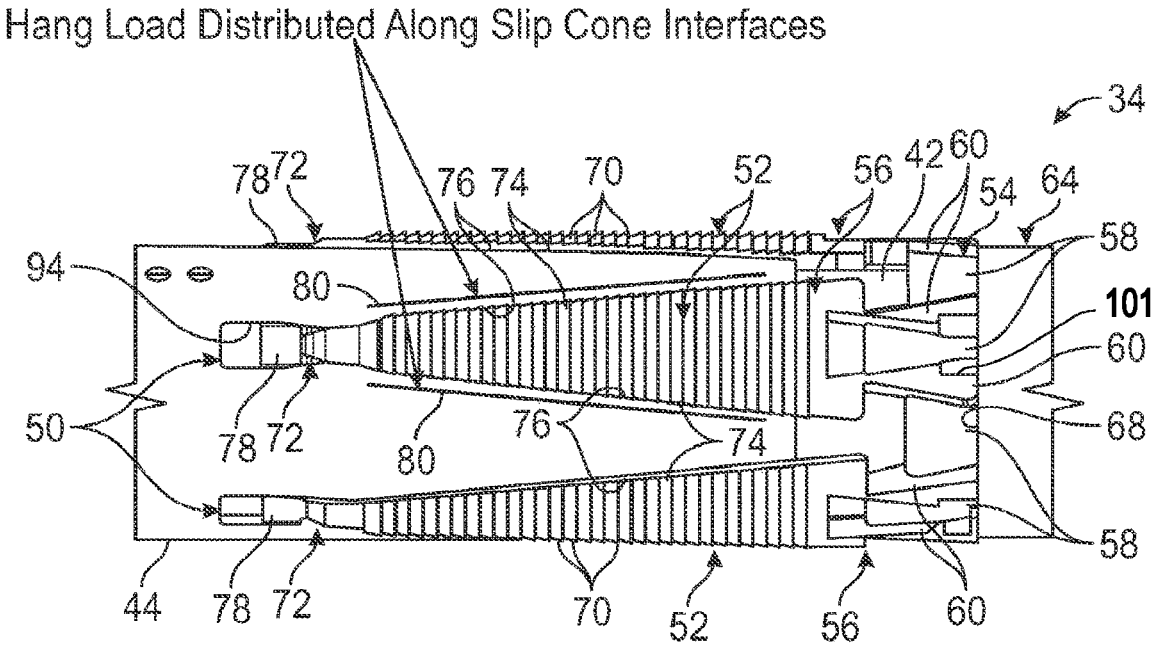
FIG. 3 is an illustration of a portion of the liner hanger showing a hanging load distributed along slip-cone interfaces once the liner hanger is set and the liner is suspended from the surrounding casing, according to an embodiment of the disclosure.

When the liner hanger 34 is set, liner 32 is suspended by the liner hanger 34 via its engagement with the surrounding casing 38. The hanging load resulting from the weight of liner 32 pulls down on mandrel 42 which, in turn, pulls down on cone 44 via abutment 46. This hanging load is distributed along the slip-cone interfaces 80 formed between angled surfaces 74, 76, as illustrated in FIG. 3. Thus, once the liner hanger 34 is set, the hanging load of liner 32 is supported by slips 52 along a plurality of the slip-cone interfaces 80 which are located circumferentially around the mandrel 42. This arrangement helps distribute the hanging load circumferentially through the cone 44 and slips 52 instead of radially into the mandrel 42.

As referenced above, the slips 52, retention ring 54, and cone 44 may each comprise angled surfaces which help retain slips 52 in position along cone 44. For example, cooperating components, e.g. slips 52 and retention ring 54, may have a plurality of angled surfaces oriented at a plurality of different angles to facilitate this retention. The different angles may be positioned along, for example, sides of slip fingers 60 and retention ring fingers 58. The "different" angles may be different angles with respect to a reference plane, such as a radial plane extending radially outward along and from a longitudinal axis of the liner hanger 34 and through the subject finger 60 or 58. For example, the differing angles on retention ring fingers 58 and on slip fingers 60 may extend outwardly from each other like a "V" and an inverse "V" thus forming mating V-angle surfaces.

Figure 4:
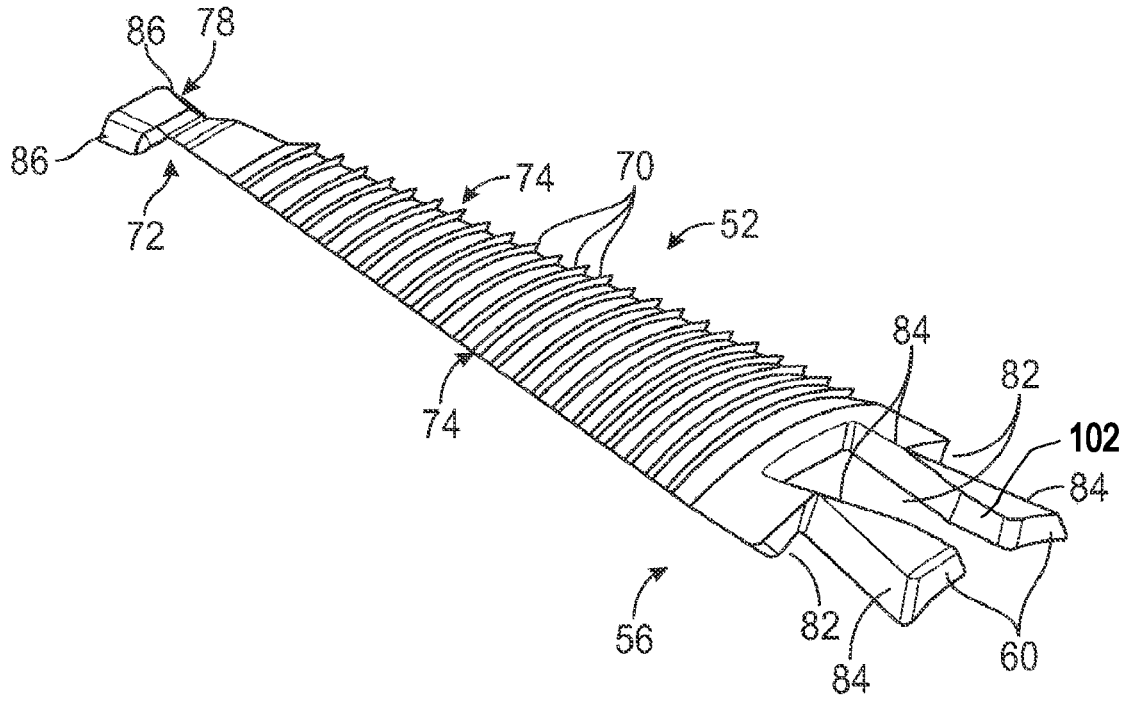
FIG. 4 is an orthogonal view of an example of a hanger slip, according to an embodiment of the disclosure.

Referring generally to FIG. 4, an example of one of the slips 52 is illustrated to facilitate explanation of features of the slip 52 including the angled surfaces which facilitate retention. In this example, the slip fingers 60 create spaces 82 therebetween to receive corresponding retention ring fingers 58. The slip fingers 60 also comprise angled surfaces 84 which interlock with corresponding surfaces of the retention ring 54, as explained in greater detail below.

By way of example, the angled surfaces 84 may be located at the sides of each slip fingers 60 and may be oriented at different angles (e.g. V-angles) with respect to a given reference plane, such as a radial plane therethrough. In the illustrated embodiment, the angled surfaces 84 of each slip fingers 60 slope towards each other moving in a radially outward direction. In other words, the angled surfaces 84 are arranged to create slip fingers 60 which have a circumferentially wider portion on a radially inward side and a circumferentially narrower portion on a radially outward side. Each slip finger 60 effectively flares to a thicker radially inward portion due to the differing angled surfaces 84. It should be noted the slip fingers 60 also may be constructed to flare outwardly in an axial direction moving from, for example, an upper end of each slip finger 60 to a lower wider end of each slip finger 60.

In this example, the hanger slip 52 also comprises head 78 in the form of a hammerhead which similarly flares to a thicker radially inward portion. The hammerhead 78 is flared due to angled surfaces 86 located along the sides of the hammerhead configuration. The angled surfaces 86 may be arranged to form the hammerhead 78 with a circumferentially wider portion on a radially inward side and a circumferentially narrower portion on a radially outward side.

Figure 5:
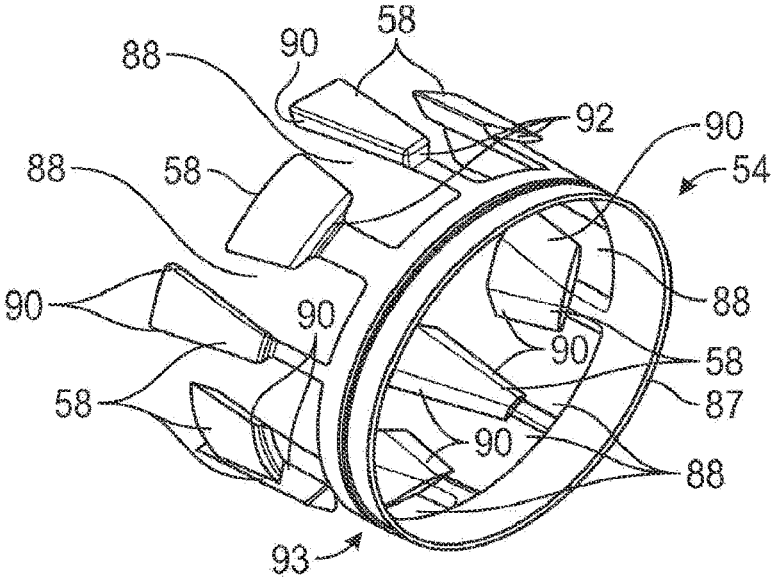
FIG. 5 is an orthogonal view of an example of a retention ring constructed to retain the hanger slips, according to an embodiment of the disclosure.

Referring generally to FIG. 5, an example of retention ring 54 is similarly illustrated to facilitate explanation of features of the retention ring 54 including the corresponding angled surfaces which facilitate retention of the slips 52. In this example, the retention ring fingers 58 extend in an axial direction from a base ring 87 and create spaces 88 therebetween to receive corresponding slip fingers 60. By way of example, the base ring 87 may be a circular body sized to slide over mandrel 42. The retention ring fingers 58 also comprise angled surfaces 90 which interlock with corresponding angled surfaces 84 of the slips 52, e.g. of the slip fingers 60.

By way of example, the angled surfaces 90 may be located at the sides of each retention ring finger 58 and may be oriented at different angles with respect to a given reference plane, such as a radial plane therethrough (e.g. reverse V-angles relative to the angled surfaces 84 of slip fingers 60). In the illustrated embodiment, the angled surfaces 90 of each retention ring finger 58 slope towards each other moving in a radially inward direction. In other words, the angled surfaces 90 are arranged to create retention ring fingers 58 which have a circumferentially wider portion on a radially outward side and a circumferentially narrower portion on a radially inward side. Each retention ring finger 58 effectively flares to a thicker radially outward portion due to the differing angled surfaces 90. It should be noted the retention ring fingers 58 also may be constructed to flare outwardly in an axial direction moving from, for example, a lower end of each retention ring finger 58 to an upper wider end of each retention ring finger 58.

Additionally, the angled surfaces 90 may be oriented generally parallel with the corresponding angled surfaces 84 once the slips 52 and the retention ring 54 are assembled onto mandrel 42. Because the retention ring fingers 58 flare to a circumferentially wider outer portion (opposite to the flare of slip fingers 60), the retention ring fingers 58 are able to trap and hold the slip fingers 60. Consequently, the slips 52 are prevented from experiencing sufficient radially outward movement that would release the slips 52 during, for example, running-in-hole.

The retention ring 54 also may comprise an abutment edge 92 to which the engagement feature 64 of cylinder 62 may be abutted when assembled. The abutment edge 92 may be used to define a cylinder engagement region 93 sized to receive engagement feature 64. In this example, engagement feature 64 may be in the form of an overlapping portion of cylinder 62. The engagement region 93 may have a reduced diameter relative to the remainder of retention ring 54 to facilitate receipt of the engagement feature/overlapping portion 64.

When the engagement feature 64 is positioned against the abutment edge 92, the slip fingers 60 are blocked from moving linearly/axially farther into the spaces 88 between retention ring fingers 58. By limiting this linear/axial movement of the slips 52, the slips 52 are prevented from shifting to a decoupling position while at the same time the cooperating angled surfaces 84, 86, 90 prevent sufficient radial movement of the slips to enable release the slips. Accordingly, the slips 52 are secured along the cone 44 and cannot be inadvertently released or set until cylinder 62 is actuated to force slips 52 to a set position.

It should be noted the retention ring fingers 58 may have a variety of sizes, shapes and configurations. In the illustrated embodiment, for example, some of the retention ring fingers 58 are axially shorter than other retention ring fingers 58. Additionally, some of the retention ring fingers 58 are circumferentially broader than other retention ring fingers 58. The slip fingers 60 also may have a variety of sizes, shapes and configurations. For example, the slip fingers 60 illustrated in FIG. 3 include a notched portion 101 while the fingers illustrated in FIG. 4 include a truncated portion 102 instead of the notched portion 101. A variety of other changes in the fingers 58, 60 also may be provided to accommodate parameters of a given construction or operation.

Figure 6:
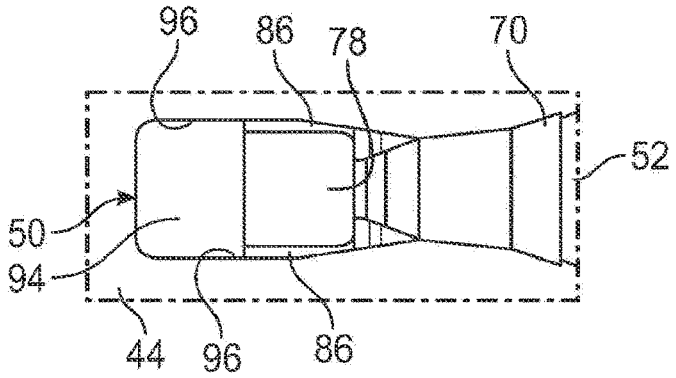
FIG. 6 is an illustration of an example of an upper end of the hanger slip engaged with the cone and shown in the set position, according to an embodiment of the disclosure.

During assembly of liner hanger 34, the head 78, e.g. hammerhead, of each slip 52 may be rotated and inserted into an expanded opening 94 at a top of the corresponding cone slot 50. The slip 52 may then be rotated back to an operational position as illustrated in FIG. 6. In this position, the angled surfaces 86 of head 78 are trapped by corresponding angled surfaces 96 of cone 44. The angled surfaces 96 extend to and define the expanded opening 94. The cooperating angled surfaces 86, 96 and the size and configuration of the cone slot 50 allow the slip 52 to move between a run-in-hole contracted configuration and an expanded set configuration (see FIG. 6) without releasing the head 78 from the cone 44.

Figure 7:
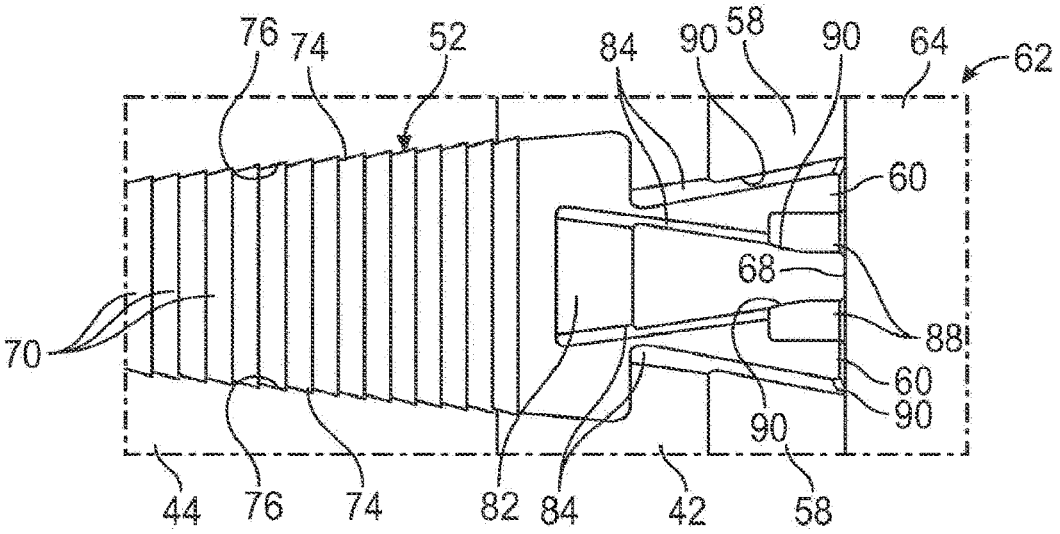
FIG. 7 is an illustration of an example of a lower end of the hanger slip engaged with the retention ring and shown in the set position, according to an embodiment of the disclosure.

Similarly, the slip fingers 60 may be moved into spaces 88 between retention ring fingers 58 and then shifted axially to interlock angled surfaces 84 of each slip 52 with the corresponding angled surfaces 90 of the retention ring 54, as illustrated in FIG. 7. At this stage, the angled surfaces 86, 96 at the top end of the slip 52 and the angled surfaces 84, 90 at the bottom and of the slip 52 limit the radially outward movement of the slip 52 and thus prevent it from releasing. Additionally, the engagement feature 64 of cylinder 62 may be moved toward the abutment edge 92 of retention ring 54 to prevent linear shifting of the slip 52 to a decoupling position. Accordingly, the cooperating angled surfaces and the engagement feature 64 ensure that the slips 52 cannot be inadvertently released from the liner hanger 34.

The cone 44, slips 52, and retention ring 54 have relatively complex configurations comprising mating surfaces arranged at different angles and orientations. Milling of such complex configurations can be time-consuming and expensive. However, at least portions of the cone 44, slips 52, and/or retention ring 54 may be cut via waterjet and/or laser cutting processes. For example, a waterjet and/or a laser may be operated in a manner which controls the thickness of the cut to allow the shapes and surfaces to be generally identical for corresponding parts, e.g. corresponding surfaces of the slips 52 and retention ring 54.

This enables a quick, cost-effective method for manufacturing the complex configurations while providing desired fitting between the cooperating components. In some embodiments, for example, the fingers 58 of the retention ring 54 and the corresponding fingers 60 of the slips 52 may be cut via waterjet cutting and/or laser cutting to form the desired angled surfaces. Similarly, other portions of the slips 52 and/or cone 44 may be cut via waterjet cutting and/or laser cutting.

It should be noted the liner 32, liner hanger 34, and running string 40 may be constructed in various sizes and configurations. Additionally, each of the components of the overall liner hanger 34 may utilize: various engagement features, differing angled surfaces, different numbers of cooperating angled surfaces, various actuators, e.g. actuating cylinders, and/or other features to enable the desired operation. For example, various numbers and types of slip fingers and corresponding retention ring fingers may be used to achieve the desired retention. Similarly, various types of hammerheads or other heads may be used with desired engagement features to facilitate retention of the upper ends of the slips.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a liner hanger comprising:

a mandrel;

a cone mounted about the mandrel, the cone comprising a plurality of tapered slots, each slot including a first portion and a second portion, the second portion including a first slot angled surface and a second slot angled surface such that a first end of the second portion is circumferentially narrower than a second end of the second portion;

a plurality of tapered slips, each tapered slip axially slidably in a corresponding tapered slot of the plurality of tapered slots, wherein each tapered slip comprises:

a plurality of slip retention fingers disposed at a first end of the tapered slip, each slip retention finger having first angled surfaces oriented at a plurality of differing angles;

a hammerhead disposed at a second end of the tapered slip, each hammerhead being further disposed in the first portion of each tapered slot; and a first slip tapered surface interfaced with the first slot angled surface; and a second slip tapered surface interfaced with the second slot angled surface;

a retention ring comprising a circular body and a plurality of ring retention fingers which extend from the circular body and the slip retention fingers, the plurality of ring retention fingers each tapering from a circumferentially wider upper end to a circumferentially narrower lower end, each ring retention finger comprising second angled surfaces, the second angled surfaces being arranged to engage the first angled surfaces of the retention fingers to prevent release of the plurality of tapered slips from the retention ring during deployment of the liner hanger; and an actuator mounted about the mandrel to selectively shift the plurality of tapered slips between a radially contracted position and a radially expanded position, wherein the first slip angled surface slides against the first slot angled surface and the second slip angled surface slides against the second slot angled surface as each tapered slip moves from the radially contracted position to the radially expanded position.

2. The system as recited in claim 1, wherein each tapered slip is wider, in a circumferential direction, at the first end than at the second end.

3. The system as recited in claim 2, wherein each hammerhead comprises sloped surfaces arranged to slidably capture the hammerhead in the first portion of the corresponding tapered slot.

4. The system as recited in claim 1, wherein the ring retention fingers of the retention ring have differing axial lengths.

5. The system as recited in claim 1, wherein the actuator comprises a hydraulically actuated cylinder which overlaps a retention ring in a manner preventing decoupling of the plurality of tapered slips.

6. The system as recited in claim 5, wherein the hydraulically actuated cylinder comprises a face which moves against the tapered slips and forces the tapered slips in an axial direction to move the plurality of tapered slips from the radially contracted position to the radially expanded position.

7. The system as recited in claim 1, wherein the cone is configured to enable installation of the plurality of tapered slips from an exterior of the cone.

8. A system, comprising:

a retention ring for retaining a plurality of slips along a liner hanger, the plurality of slips being selectively set via a hydraulic cylinder mounted about a mandrel, the retention ring comprising:

a circular body sized to fit over the mandrel;

a plurality of fingers extending from the circular body, the plurality of fingers each taper from a circumferentially wider upper end to a circumferentially narrower lower end, the plurality of fingers having spaces there between and at different cooperating angles arranged to enable insertion and retention of the plurality of slips; and a cylinder engagement region sized to receive an overlapping portion of the hydraulic cylinder to prevent decoupling of the plurality of slips after assembly of the liner hanger, the overlapping portion being received on an opposite end of the circular body relative to the plurality of fingers.

9. The system as recited in claim 8, wherein the cylinder engagement region has a reduced diameter relative to the remainder of the retention ring.

10. The system as recited in claim 8, wherein different fingers of the plurality of fingers have different axial lengths.

11. The system as recited in claim 8, wherein some of the different cooperating angles are formed by circumferential sides of each finger and extend from a smaller radially inward portion of the finger to a larger radially outward portion of the finger.

12. A method, comprising:

providing a cone with a plurality of slots, each slot for receiving a corresponding slip of a plurality of slips;

trapping an upper end of each slip in an upper portion of the corresponding slot;

retaining a lower end of each slip via a retention ring comprising a circular body and a plurality of fingers extending from the circular body, the plurality of fingers each tapering from a circumferentially wider upper end to a circumferentially narrower lower end; and further securing the slips against release by blocking disassembly via a hydraulic cylinder used for setting the slips.

13. The method as recited in claim 12, wherein trapping comprises forming the upper end as a flared hammerhead which may be trapped under corresponding sloped surfaces of the cone.

14. The method as recited in claim 12, wherein retaining comprises forming the lower end of each slip with a plurality of slip fingers which may be inserted into spaces between the fingers of the retention ring.

15. The method as recited in claim 14, wherein retaining comprises using cooperating angled surfaces of the slip fingers and the fingers of the retention ring to prevent each slip from releasing from the cone in a radially outward direction.

16. The method as recited in claim 15, wherein securing comprises using the hydraulic cylinder to block the slips against undue movement in an axial direction, thus ensuring the slips remain held in place by the cooperating angled surfaces.

17. A method, comprising:

positioning a cone of a liner hanger over a mandrel;

installing a plurality of slips along the cone by trapping an upper end of each slip in an upper portion of a corresponding slot formed in the cone;

securing a lower end of each slip with a retention ring comprising a circular body and a plurality of fingers extending from the circular body, the plurality of fingers each tapering from a circumferentially wider upper end to a circumferentially narrower lower end, and the plurality of fingers being positioned to prevent release of each slip; and overlapping a portion of the retention ring with a cylinder to ensure the slips remain secured against release by limiting axial movement of the slips with respect to the cone.

18. The method as recited in claim 17, further comprising forming the fingers of the retention ring via at least one of waterjet cutting and laser cutting.

19. The method as recited in claim 17, further comprising forming the slips and the cone via at least one of waterjet cutting and laser cutting.

* * * * *